US008827780B1

(12) United States Patent
Benson et al.

(10) Patent No.: US 8,827,780 B1
(45) Date of Patent: Sep. 9, 2014

(54) FAN COIL BLOCK AND GRID CONFIGURATION SYSTEM

(75) Inventors: David Emmett Benson, Beaverton, OR (US); Kent Peterson, Long Beach, CA (US); Michael Thomas Post, West Linn, OR (US)

(73) Assignee: Huntair, Inc., Tualatin, OR (US)

( * ) Notice: Subject to any disclaimer, the term of this patent is extended or adjusted under 35 U.S.C. 154(b) by 0 days.

(21) Appl. No.: 10/334,958

(22) Filed: Dec. 30, 2002

Related U.S. Application Data

(60) Provisional application No. 60/345,875, filed on Dec. 28, 2001.

(51) Int. Cl.
*F24F 7/08* (2006.01)
*F24F 7/10* (2006.01)
*B01L 1/04* (2006.01)

(52) U.S. Cl.
USPC ..... 454/233; 454/236; 454/187

(58) Field of Classification Search
USPC ..... 454/187, 233, 236, 329, 338; 52/302.1; 1/187, 233, 236, 329, 338
See application file for complete search history.

(56) References Cited

U.S. PATENT DOCUMENTS 3,638,404 A * 2/1972 Moll et al. ..... 55/473
4,473,107 A * 9/1984 Fairbrother et al. ..... 165/214
4,513,545 A * 4/1985 Hopkins, Jr. ..... 52/79.1
4,632,020 A * 12/1986 Houwer ..... 454/233
5,613,759 A 3/1997 Ludwig et al.
5,664,995 A 9/1997 O'Keefe
5,794,397 A 8/1998 Ludwig
5,922,095 A * 7/1999 Hustvedt et al. ..... 55/385.1
6,183,528 B1 2/2001 Jeanseau et al.
6,344,065 B1 2/2002 Boulva
6,471,582 B1 10/2002 Tucker
6,497,739 B2 12/2002 McGill
6,551,185 B1 * 4/2003 Miyake et al. ..... 454/234

OTHER PUBLICATIONS

Heatcraft, Inc., Fluid Coils, www.heatcraftheattransfer.com/products/fluid.asp, 2002.

* cited by examiner

*Primary Examiner* — Jiping Lu
(74) *Attorney, Agent, or Firm* — Schwegman Lundberg & Woessner, P.A.

(57) ABSTRACT

A fan coil block of the present invention preferably includes a fan for drawing air and a cooling device for cooling air drawn by the fan. A flexible air handling system of the present invention preferably includes a fan coil block that is supportable overhead by an overhead support system. The present invention is also directed to an air handling method that includes the steps of providing an overhead support system for supporting overhead devices, defining a return air chase within the interior space of a building, and supporting a fan coil block above or within the return air chase using the overhead support system. The fan coil block draws and cools air from the return air chase and returns the cooled air to a plenum above the overhead support system.

15 Claims, 9 Drawing Sheets

66

66

FAN COIL BLOCK AND GRID CONFIGURATION SYSTEM

The present application is a nonprovisional of U.S. Provisional Patent Application Ser. No. 60/345,875, filed Dec. 28, 2001. The present application is based on and claims priority from this provisional application, the disclosure of which is hereby incorporated herein by reference.

BACKGROUND OF INVENTION

The present invention is directed to a unique fan coil block that may be used in a unique grid configuration system.

The key to building construction today is both economy and flexibility. Many systems for air handling, electrical, plumbing, and other construction systems have been developed that are economical because they can be produced and installed inexpensively. Because the systems are used for many different types of buildings, it is imperative that the systems be extremely flexible.

One example of a system that has been adopted by the construction industry is the use of an overhead grid array system 20 such as that shown in FIG. 1. The grid array system 20 may be used to support overhead devices such as fan filter units, air filters, light fixtures, sprinkler systems, smoke detectors, electrical wiring, and other overhead structure and devices. In one preferred embodiment, the grid array system 20 is constructed from a plurality of supporting elements, rails, or beams (hereinafter "supporting elements 22"). The supporting elements 22 intersect or pass near each other to form grid units 24 that are the open spaces between the supporting elements 22. Overhead devices are supported within the grid units 24. There are many different types of grid array systems 20 and many different sizes of grid units 24 (for example, 2'×4' or 4'×4'). Most grid array systems 20 use a single size grid unit 24 and repeat the pattern throughout the entire building 66. It should be noted, however, that the sizes of the grid unit 24 could be varied, even within a single building or within an individual room of a building.

FIG. 2 shows an exemplary two-sided supporting element 22 of an exemplary generic prior art grid array system 20. In this exemplary embodiment, at least two sides of each grid unit 24 preferably have a lip 26 to support an overhead device. The shown two-sided supporting element 22 has a lip 26 on both sides so that it can at least partially support an overhead device on both sides of the supporting element 22. A single-sided supporting element, such as that used on an exterior wall, might only have a single lip. The supporting element 22 of FIG. 2 is a generic supporting element as alternative grid array systems 20 may use alternative structure.

Clean rooms 30 are commonly used in industries such as the electronic, medical, and pharmaceutical industries, to reduce the number of particles in the air to specified limitations. In the most common approach, a layer of flat filters is suspended (sometimes in a grid system) from a room ceiling, with the filters extending over the entire area of the ceiling or a partial area of the ceiling. The air is conducted from a plenum above through the filters into an open space in the room and then returned back to the plenum by way of outlets in the room. The filter elements are normally supported or held in place by supporting elements, such as the supporting elements of a grid array system that engage all or part of the peripheral frame of each filter element.

FIGS. 3 and 4 show fan filter units 40 (a single fan filter unit 40 being outlined in phantom) being used in exemplary prior art air handling systems arranged in the grid array system 20. In the most basic form, a fan filter unit 40 is a combination of a filter 42 and a fan 44. These fan filter units 40 come in many sizes and shapes, but for exemplary purposes, the common 2'×4' dimension unit will be discussed. These 2'×4' fan filter units may be arranged in a grid array system 20 in the ceiling of, for example, a clean room 30. The fan 44 of the fan filter unit 40 blows air down through the filter 42 of the fan filter unit 40. Placement of multiple fan filter units 40 in the grid array system 20 provides uniformity of airflow.

To use the systems of FIGS. 3 and 4, the air must be cooled before it reaches the fan filter units 40. As shown in FIG. 3, one way to cool the air being blown by the fan filter units 40 is to provide a remote cooling fan 46 in the plenum 50 above the fan filter units 40. The remote cooling fan 46 cools the air in the plenum 50. The fan filter units 40 then circulate the cool air. As shown in FIG. 4, another way to cool the air being blown by the fan filter units 40 is to provide a cooling coil 52 under the floor 54 of the clean room 30. In known systems, the cooling coil 52 is located near a return air chase 60 in which a return fan 62 directs air back to the plenum 50 above the fan filter units 40. The cooling coil 52 cools the air that is then returned to the plenum 50. The fan filter units 40 then circulate the cool air.

The embodiments of both FIG. 3 and FIG. 4 use an exterior, predetermined return air chase 60. Air flows throughout the rooms 30 in one direction (generally downward) and exits through a perforated floor 54. The air then is driven or pulled to the substantially adjacent return air chase 60. FIG. 1 is a top plan view of an exemplary prior art grid array system 20 in which the exterior return air chase 60 is positioned against the exterior wall 64 of the building 66. The embodiments of FIGS. 3 and 4 could only be implemented for the rooms 30 in the building 66 that have at least one wall adjacent to the return air chase 60. This limitation creates several problems. First, as can be seen from FIG. 1, rooms 30 that are to have airflow such as that shown in FIGS. 3 and 4 must be positioned against the exterior wall 64 of the building 66. This limits the arrangements of rooms within the building. Second, the exterior return air chase 60 is essentially wasted space.

The present invention solves the problems of the known prior art.

BRIEF SUMMARY OF THE INVENTION

The present invention is directed to a fan coil block, flexible air handling system, and air handling method.

A fan coil block of the present invention preferably includes a fan for drawing air and a cooling device for cooling air drawn by the fan.

A flexible air handling system of the present invention preferably includes a fan coil block that is supportable overhead by an overhead support system. In one preferred embodiment, the overhead support system is a unique grid configuration system.

The present invention is also directed to an air handling method that includes the steps of providing an overhead support system for supporting overhead devices, defining a return air chase within the interior space of a building, and supporting a fan coil block above or within the return air chase using the overhead support system. The fan coil block draws and cools air from the return air chase and returns the cooled air to a plenum above the overhead support system.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
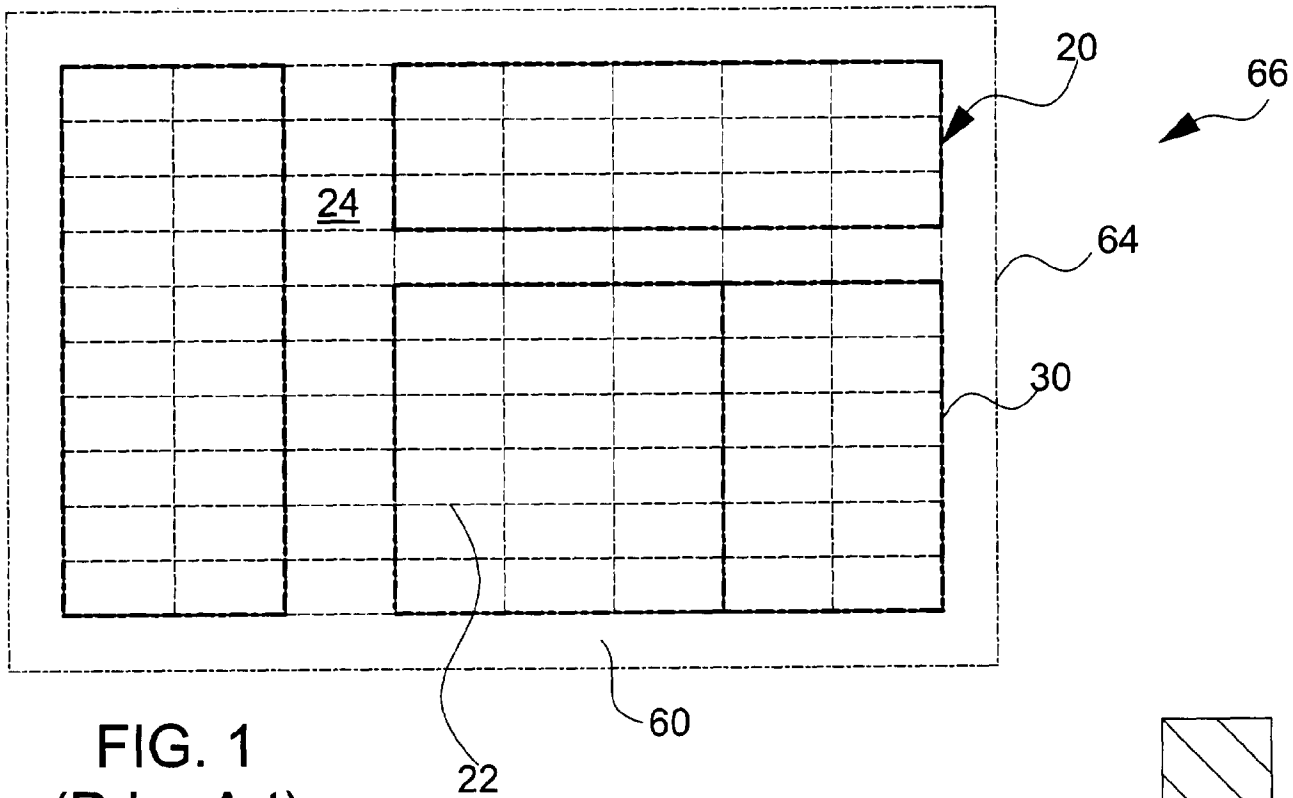
FIG. 1 (Prior Art)
FIG. 1 is a top plan view of an exemplary prior art grid array system in which the return air chase is positioned against the exterior wall of the building.

The present invention, as shown in FIGS. 5-10 is directed to a flexible air handling system that uses a fan coil block 70 that can be used in an overhead support system such as a unique grid configuration system 72. The fan coil block 70 (shown in detail in FIGS. 8 and 9) preferably includes a fan 44 and a cooling device 74. Using the present invention, a return air chase 80 may be positioned anywhere in the unique grid configuration system 72, including in an interior space of a building 66. There is no need to reserve an exterior return air chase if the present invention is used. Further, in one preferred embodiment of the invention, the fan coil block 70 is movable or relocateable so that it is relatively simple to change the arrangement of the interior space of the building 66 (for example, from the arrangement shown in FIG. 6 to the arrangement shown in FIG. 7). In a building 66 using the present invention, fan coil blocks 70 can be easily relocated, added, or removed depending on the arrangement desired.

Figure 3:
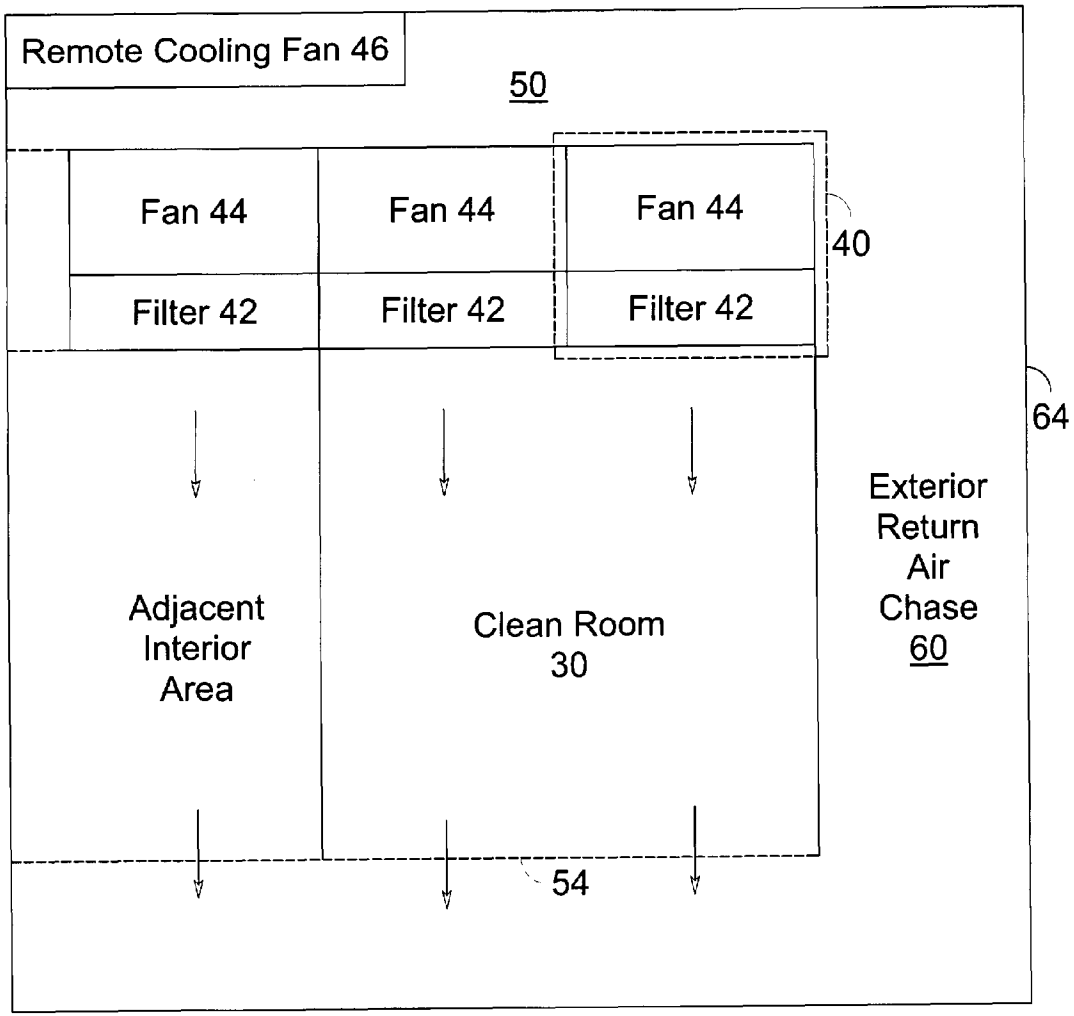
FIG. 3 (Prior Art)
FIG. 3 is a side view of a fan filter unit and a remote cooling fan system.
Figure 4:
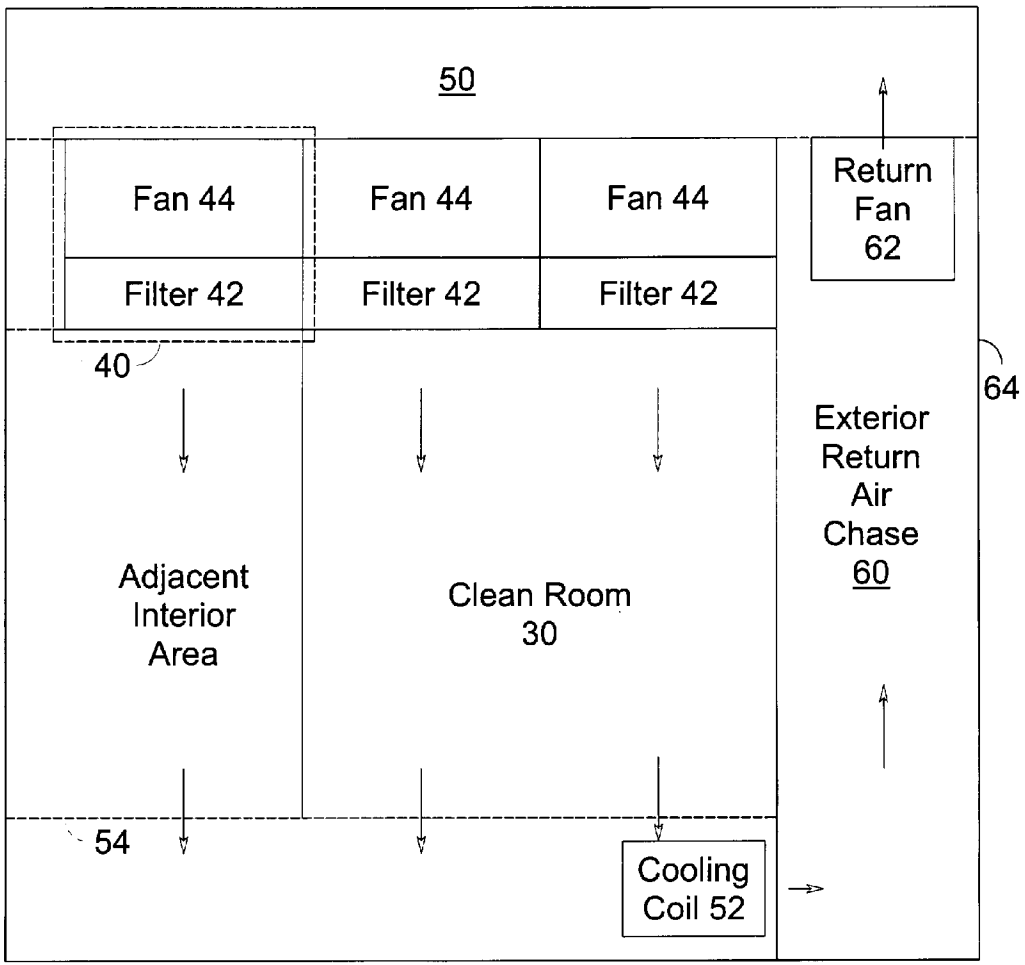
FIG. 4 (Prior Art)
FIG. 4 is a side view of a fan filter unit and an exterior return air chase.

As mentioned above, the key to building construction today is both economy and flexibility. The embodiments of FIGS. 1, 3, and 4 use an exterior, predetermined return air chase 60 in which the exterior return air chase 60 is positioned against the exterior wall 64 of the building 66. The embodiments of FIGS. 3 and 4 could only be implemented for the rooms 30 in the building 66 that have at least one wall adjacent to the return air chase 60. This severely limits the flexibility of the system as it limits the arrangements of rooms within the building. Further, the exterior return air chase 60 is essentially wasted space.

Figure 5:
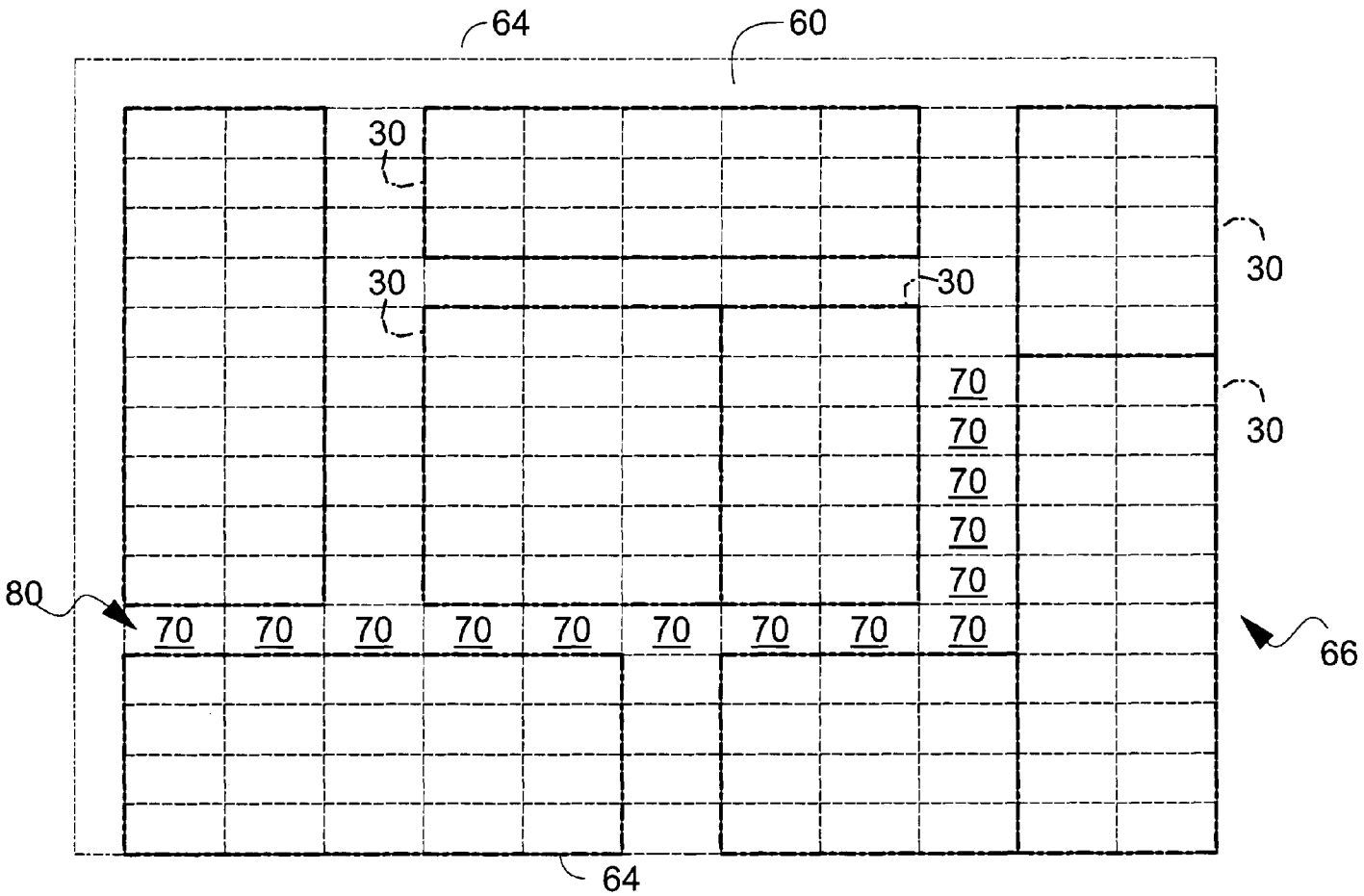
FIG. 5 is a top plan view of a unique grid configuration system of the present invention in which the return air chase may be positioned in an interior space and/or may be moved depending on the desired arrangement of the rooms of the building.

FIG. 5 shows a building 66 in which the present invention is at least partially implemented. There is still an exterior return air chase 60 along two exterior walls 64 of the building. The other two exterior walls 64 do not have an adjacent exterior return air chase. A building such as this might exist if it was partially converted to use the present invention. Most likely, new construction would not have an exterior return air chase 60 because it would be wasted space. As can be seen from the arrangement of FIG. 5, it is possible to have rooms 30 that use the present invention even within the interior space of the building 66. By using one or more fan coil blocks 70 above an adjacent interior area to a room 30, an interior return air chase 80 is created.

It should be noted that the present invention is particularly useful for building in which clean rooms are used because the present invention helps air flow in a single direction. Clean rooms, however, are meant to be exemplary rooms 30 as the present invention may be implemented with other types of rooms or combinations of clean rooms and other types of rooms.

Figure 6:
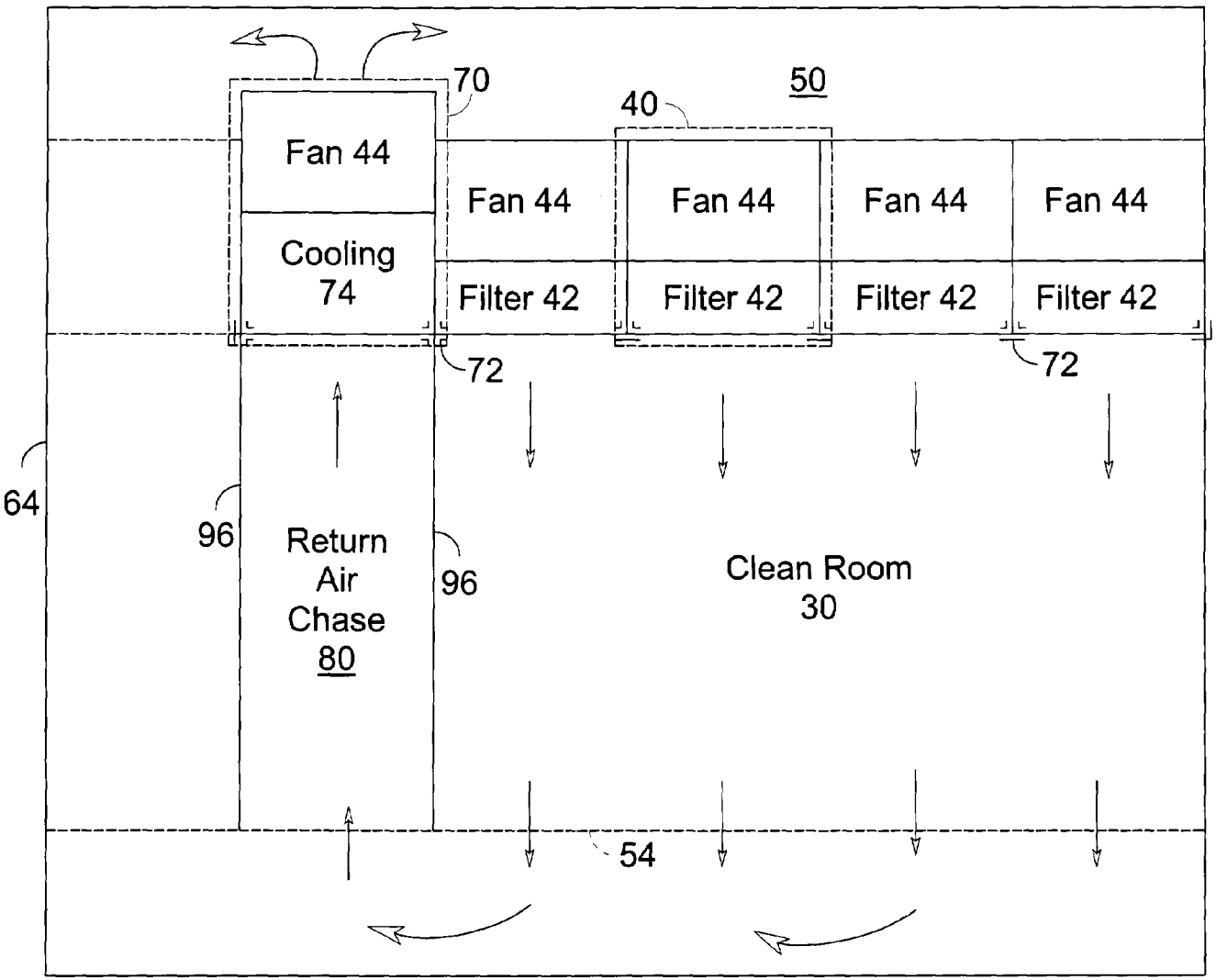
FIG. 6 is a side view of a fan coil block of the present invention used in a unique grid configuration system of the present invention such that the return air chase may be positioned in an interior space and/or may be moved depending on the desired arrangement of the rooms of the building.
Figure 7:
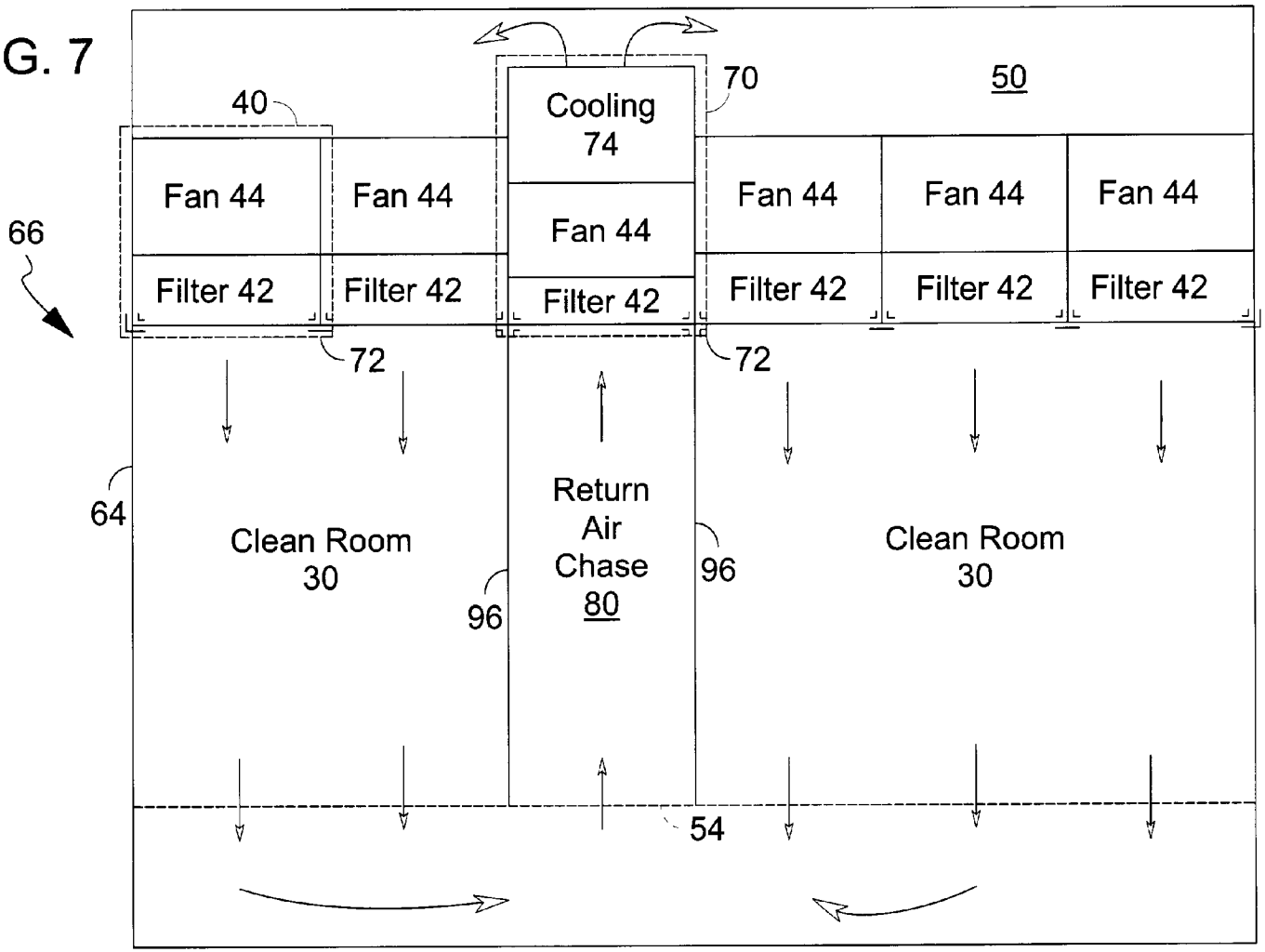
FIG. 7 is a side view of the building of FIG. 6 in which the arrangement of rooms has been changed.

In the embodiments shown in FIGS. 5-7, cool air from the plenum 50 is circulated in one direction (generally downward) by the fan filter units 40 into the rooms 30. The air flows throughout the rooms 30 in one direction (generally downward) and exits through a perforated floor 54. Air flows to the return air chase 80 because it has the least pressure. Specifically, air is being driven downward through the perforated floors of the rooms 30, but being pulled upward from the return air chase 80. The air then is driven or pulled to the substantially adjacent return air chase 80 by the fan 44 of the fan coil block 70. As the air is being driven or pulled by the fan 44, it is being cooled by the cooling device 74 of the fan coil block 70. The cooled air is then returned to the plenum 50 for recirculation.

Figure 2:
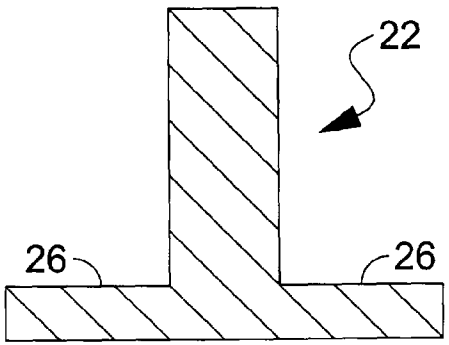
FIG. 2 (Prior Art)
FIG. 2 is a cross sectional view of an exemplary two-sided supporting element of an exemplary prior art grid array system.

The overhead support system or unique grid configuration system 72 is designed to hold overhead devices in the building 66. In one preferred embodiment, the unique grid configuration system 72 uses a single size grid unit and repeats the pattern throughout the entire building 66. It should be noted, however, that the sizes of the grid unit could be varied, even within a single building or within an individual room of a building. The grid configuration system might be a generic overhead support system 20, 22 such as that shown in FIG. 2 or it may be a specialized grid system 72 such as that shown in FIG. 10. One preferred embodiment of the present invention uses the grid system described in U.S. Pat. No. 5,613,759 to Ludwig et al. and U.S. Pat. No. 5,794,397 to Ludwig, the information from both patents being incorporated herein by reference. Another exemplary grid system that could be used or modified to be used to implement the present invention is shown and described in U.S. Pat. No. 6,497,739 to McGill, the specification of which is incorporated herein by reference. Although the present invention is discussed in terms of using a grid system to support overhead devices, alternative overhead support systems might be used to implement the present invention, as it is not limited to any particular overhead support system for supporting overhead devices. An alternative overhead support system that could be used to implement the present invention is shown and described in U.S. Pat. No. 6,183,528 to Jeanseau et al., the specification of which is incorporated herein by reference. Other alternative support systems such as gridless systems and systems that use existing walls to support the unit may be used to implement the present invention.

Figure 8:
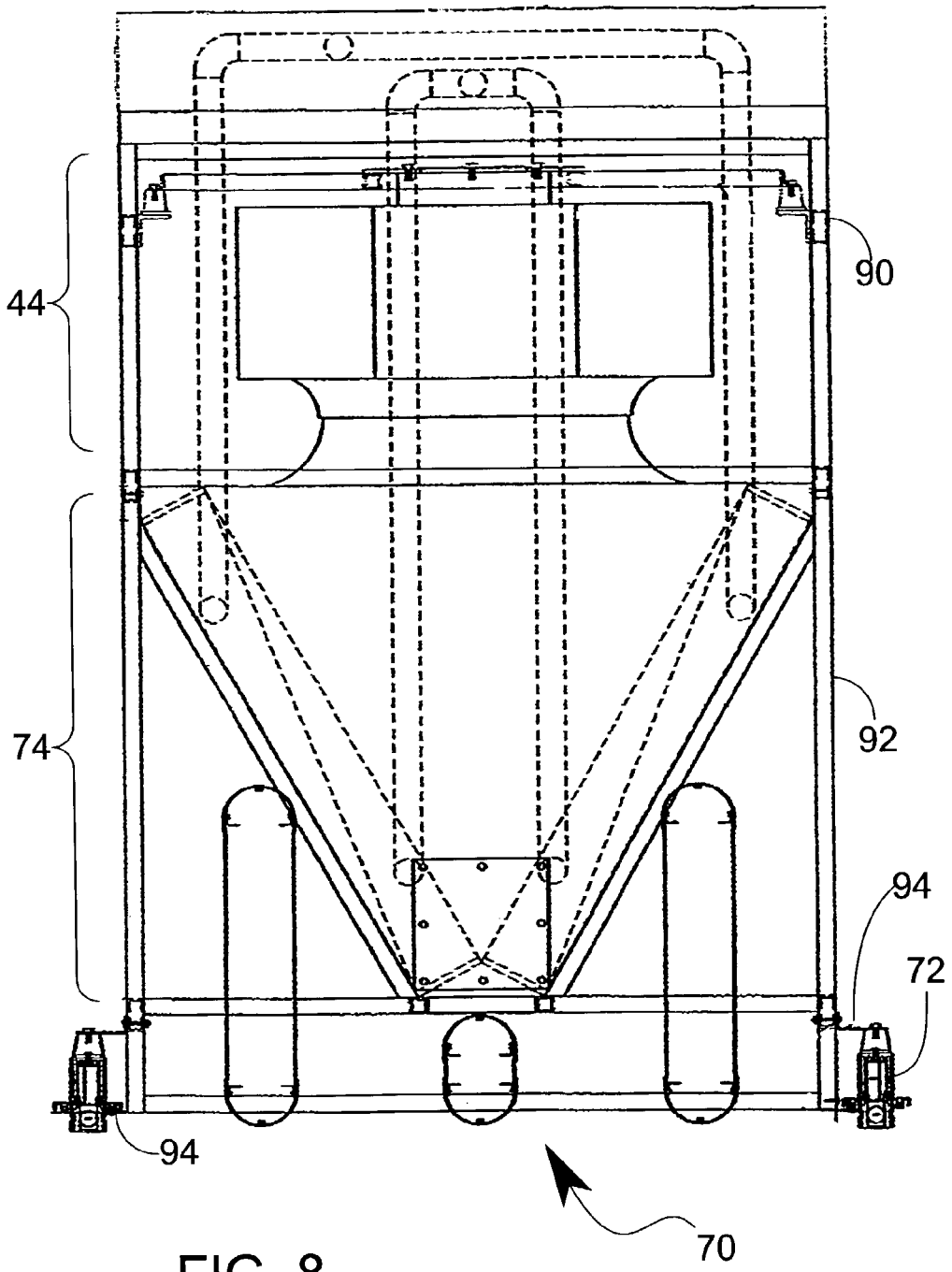
FIG. 8 is a first cross-sectional side view of an exemplary fan coil block of the present invention.
Figure 9:
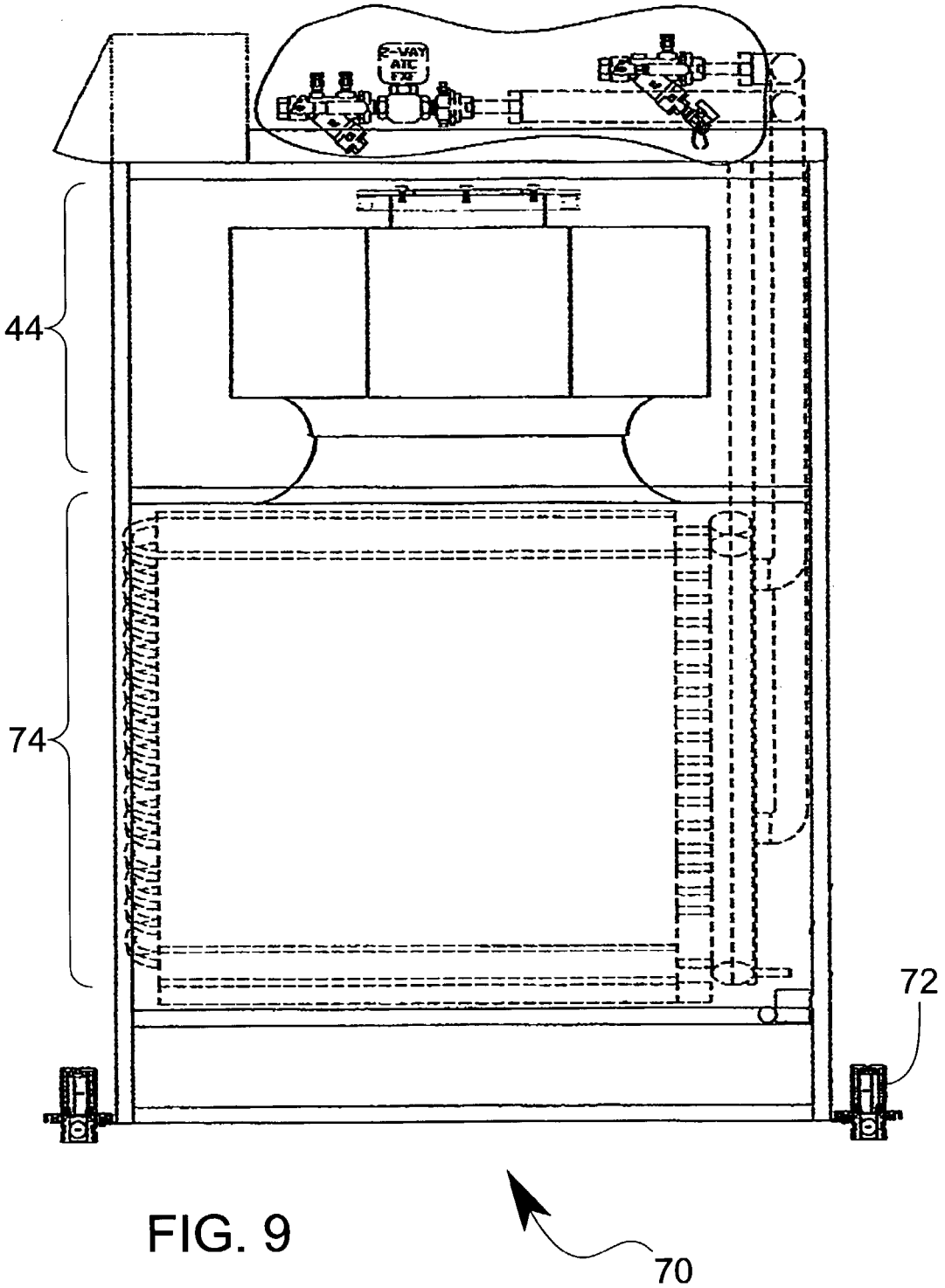
FIG. 9 is a second cross-sectional side view of the exemplary fan coil block of the present invention.
Figure 10:
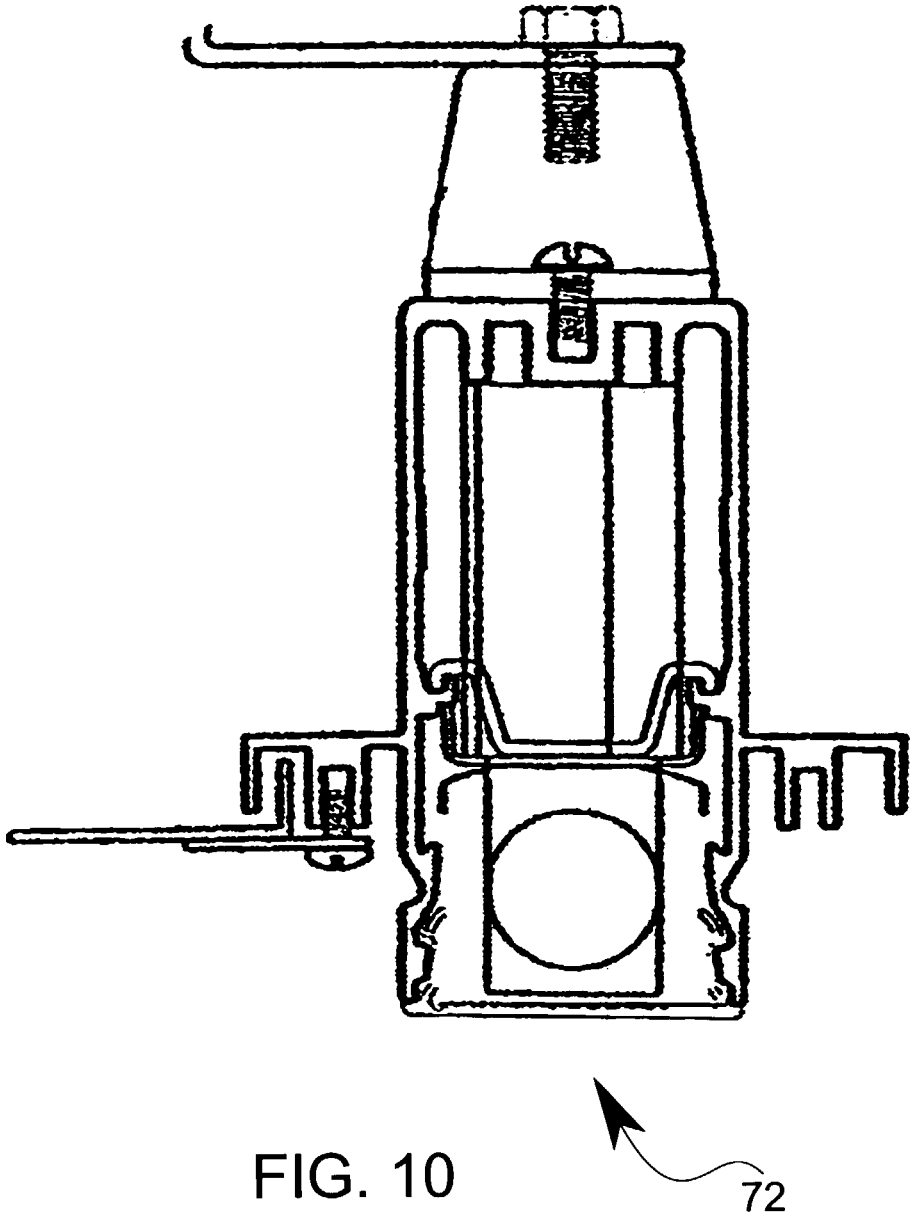
FIG. 10 is a cross-sectional side view of an exemplary supporting element of the present invention.

The fan coil block 70 of the present invention preferably includes a fan 44 and a cooling device 74. The fan 44 draws air from the return air chase 80 below the fan coil block 70. The cooling device 74 cools the air drawn by the fan 44. As shown in FIGS. 6, 8, and 9, the fan 44 may be positioned above the cooling device 74. As shown in FIG. 7, the fan 44 may be positioned below the cooling device 74. As also shown in FIG. 7, a filter 42 may be incorporated into the fan coil block 70 for added filtering. Although the filter 42 is shown below the fan in FIG. 7, it may also be positioned between the fan and the cooling device 74 or above the cooling device 74. Although shown with only a single fan 44, cooling device 74, and optional filter 42, more than one of each of these elements may be used. Further, additional elements may be added without affecting the scope of the invention as long as they additional elements did not interfere with the functioning of the elements disclosed. Alternative configurations may be possible. The fan 44, cooling device 74, and optional filter 42 may be integral in the sense that they are connected as a single unit. The individual elements may be removably interconnected.

In an exemplary embodiment, the fan 44 is a motorized fan assembly driven by one or more asynchronous (AC) motors or by electronically commutated (EC or brushless DC) motors. The exemplary motor may be equipped with an exterior rotor motor, integrated inside the impeller. Preferably the fan is speed controlled, energy optimized, has a low noise level, and presents a compact design. The EC-technology offers the possibility to control digitally thousands of fan units jointly or individually from one (or more) central control system. Using this technology, even large systems are so flexible that changes in room arrangement are relatively simple.

In an exemplary embodiment, the cooling device 74 is a heat exchanger, radiator or other device capable of cooling air passing therethrough. The cooling device 74 may be a custom-made cooling device. Alternative cooling devices may be used.

In an exemplary embodiment, the optional filter 42 is a bottom load filter with a gel seal. The filter 42 may be a chemical vapor filter (CVF) that is designed to absorb airborne molecular contaminants to less than 1 PPB levels depending upon the application. The filter 42 may also be a bottom load HEPA or ULPA filter. Optionally there may be a removable perforated face screen on the filter 42.

In alternative embodiments, the fan coil block 70 of the present invention may also incorporate sound baffling, sound splitters, piping components, electronics, mounting clips, control valves, and other features necessary to make the fan coil block 70 functional as a unit.

As mentioned, the fan 44, cooling device 74, optional filter 42, and other elements of the fan coil block 70 may be integral in the sense that they are connected as a single unit. This may be accomplished by the use of a frame enclosure 90 with a panel assembly 92. Alternate means for connecting the individual elements are possible. In the embodiments shown in FIGS. 8 and 9, mounting devices 94 are attached to the lower periphery of the frame to assist in mounting the fan coil block 70 to the grid configuration system 72.

The dimensions of the fan coil block 70 are preferably suitable for use in a grid configuration system 72 such that it can be used with known filter fan units 40. The height of the fan coil block 70 is only limited by the height of the plenum 50. The width and length of the fan coil block 70 could be varied in the same way that fan filter unit height and with dimensions are varied depending on intended use.

It should be noted that the fan coil block 70 of the present invention could be used within a room 30 if there is a high heat load or if air uniformity is not an issue in a particular room 30.

The fan coil block 70, as described, has several features that make it particularly useful. For example, the fan coil block 70 is movable. In the prior art systems shown in FIGS. 1, 3, and 4, the exterior return air chase 60 is permanently located adjacent an exterior wall 64 of the building 66. It would be difficult or impossible to change the location of the exterior return air chase 60. If a building 66 is redesigned (for example, the clean room is expanded) interior walls 96 tend to move. The present invention is able to easily adapt to the redesigned building arrangement. For example, in the preferred embodiment, the dimensions and support structure of the fan coil block 70 are suitable for use in an overhead support system used with known filter fan units 40. This type of modularity makes it easy to move the fan coil block 70 to a suitable position anywhere within the interior space of the building 66.

FIGS. 6 and 7 show an exemplary situation in which the fan coil block 70 is moved to change the arrangement of the interior space of the building 66. In the arrangement shown in FIG. 6, there is a single, relatively large clean room 30 on one side of the return air chase 80 and essentially wasted space on the other side of the return air chase 80. In this embodiment, the supporting elements of the grid configuration system 72 can be used to either support fan filter units 40 or fan coil blocks 70. (It should be noted that although the supporting elements are shown in FIGS. 6 and 7 as being L-shaped, T-shaped, and +-shaped, the supporting elements may be generic such that only one shape is needed.) To create the arrangement shown in FIG. 7 in which there are two clean rooms, the fan coil block 70 is moved in a first direction by one grid unit, the fan filter unit 40 that the fan coil block 70 replaced is moved in a second direction opposite the first direction by one grid unit, and an additional fan filter unit 40 is added. The interior walls 96 are moved to either side of the fan coil block 70 to create a return air chase 80. It should be noted that the return air chase may be a dedicated space or it may be a space in which the flow direction of air is not crucial (e.g. a hallway, a bathroom, or a storage room).

An air handling method of the present invention includes the first step of supporting overhead devices using an overhead support system. A return air chase 80 may be defined anywhere within the interior space. The return air chase may be defined by isolating a portion of the interior space to allow air to flow in a predetermined direction therethrough. In the shown embodiments the return air chase 80 is defined or isolated using interior walls. Other means for defining or isolating interior spaces such as the use of air ducts, and other means common in the industry may also be used. The fan coil block 70 may then be supported above and/or within the return air chase using the overhead support system.

When the present invention is in use, air is drawn from the return air chase 80 using a fan 44 of the fan coil block 70. The air drawn by the fan is then cooled using a cooling device 74 of the fan coil block 70. The air cooled by the cooling device is then returned to a plenum 50 above the overhead support system. In one preferred embodiment, cool air from the plenum is then circulated throughout a room 30, preferably in a single direction, using a fan 44 or a fan filter unit 40. The air flows through a perforated floor 54 or other outlet in the room 30. The air then returns to the return air chase 80.

Using the present invention, the arrangement of rooms 30 within a building 66 may easily be changed by redefining the return air chase 80 within the interior space to form a redefined return air chase 80 in an alternate location within the interior space and then resupporting the fan coil block 70 within the redefined return air chase 80 using the overhead support system.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. An air handling system for filtering air in a building, said air handling system comprising:

a support grid extending along a ceiling of the building and spaced apart from the ceiling to form an air carrying plenum located between said support grid and the ceiling, said support grid configured to support overhead devices, said support grid comprising openings to a room of the building;

fan filter units positioned in corresponding openings of said support grid, said fan filter units to draw air from the plenum and to discharge the air into the room of the building;

a return air chase in fluid communication with at least one of said openings in said support grid and in fluid communication with the room and the plenum to return the air from the room to the plenum; and at least one fan coil block comprising a fan and a cooling device, said fan coil block supported by said support grid and positioned within at least one of said openings in said support grid at a discharge end of said return air chase, said fan coil block configured to cool the air returned to the plenum from the return air chase.

2. An air handling system in accordance with claim 1, wherein said support grid comprises:

support elements suspended from the ceiling; and support rails extending between said support elements to form said support grid and said openings.

3. An air handling system in accordance with claim 2, wherein said fan filter units are mounted on said support rails and positioned in said corresponding openings of said support grid such that said support elements and said support rails bear the weight of said fan filter units.

4. An air handling system in accordance with claim 2, wherein said at least one fan coil block is mounted on said support rails and positioned in said at least one of the openings of said support grid such that said support elements and said support rails bear the weight of said at least one fan coil block.

5. An air handling system in accordance with claim 1, wherein said discharge end of said return air chase is joined to said opening in which said at least one fan coil block is supported.

6. An air handling system in accordance with claim 1, wherein said fan filter units are interchangeably moveable from one to another of said openings formed in said support grid.

7. An air handling system in accordance with claim 1, wherein said at least one fan coil block is interchangeably moveable to any of said openings formed in said support grid.

8. An air handling system in accordance with claim 1, wherein said return air chase is located directly below and extends upward to said support grid, said return air chase located within or adjacent an interior wall that surrounds a room of the building, said return air chase coupled to at least one of said openings in said support grid.

9. An air handling system in accordance with claim 1, wherein the building has exterior walls and a room surrounded by interior walls, said return air chase positioned remotely from the exterior walls and within the room within the interior walls.

10. An air handling system in accordance with claim 1, wherein said return air chase extends directly downward from an opening in said support grid to a floor of the building.

11. An air handling system for filtering air in a building having exterior walls, the building having a room surrounded by interior walls, said air handling system comprising:

a support grid held above the room, extending over the interior walls and spaced apart from a ceiling of the building to form an air carrying plenum between said support grid and the ceiling, said support grid configured to support overhead devices and comprising openings to the room;

a return air chase located directly below and extending upward to said support grid, said return air chase located within or adjacent one of the interior walls that surround the rooms, said return air chase coupled to at least one of said openings in said support grid and in fluid communication with the room and the plenum to return the air from the room to the plenum; and at least one fan coil block comprising a fan and a cooling device, said fan coil block supported by said support grid and positioned within at least one of said openings in said support grid at a discharge end of said return air chase, said fan coil block configured to cool the air returned to the plenum from the return air chase.

12. An air handling system in accordance with claim 11, wherein building includes at least two adjacent rooms having interior walls that form sides of said return air chase.

13. An air handling system in accordance with claim 12 further comprising fan filter units positioned in corresponding openings of said support grid, each of the fan filter units to draw air from the plenum and to discharge the air into one of the room and the adjacent room of the building.

14. An air handling system in accordance with claim 11, wherein the return air chase includes a discharge end joined to an opening of said support grid, said return air chase interchangeably moveable from one to another of said openings of said support grid to accommodate changes in an interior of the building.

15. An air handling system in accordance with claim 11, wherein the plenum constitutes an air carrying non-ducted plenum having a side defined by and spanning across an upper surface of said support grid.

* * * * *